United States Patent [19]

Wilson et al.

[11] Patent Number: 4,457,545

[45] Date of Patent: Jul. 3, 1984

[54] DOOR LATCH ASSEMBLY

[75] Inventors: Arthur C. Wilson; Ray C. Eigelback, both of Louisville, Ky.

[73] Assignee: General Electric Company, Louisville, Ky.

[21] Appl. No.: 374,361

[22] Filed: May 3, 1982

[51] Int. Cl.[3] ..... E05C 9/04

[52] U.S. Cl. ..... 292/29; 292/DIG. 69

[58] Field of Search ..... 292/29, 30, 52, 53, 292/126, 219, 226, DIG. 5, DIG. 69, 336.3

[56] References Cited

U.S. PATENT DOCUMENTS

| | | | |
|---|---|---|---|
| 1,996,454 | 4/1935 | Brown | 292/49 |
| 2,498,508 | 2/1950 | Rudolph | 292/24 |
| 2,992,031 | 7/1961 | Krause et al. | 292/29 |
| 3,033,634 | 5/1962 | Ribbens et al. | 312/219 |
| 3,099,471 | 7/1963 | Scott et al. | 292/7 |
| 3,596,952 | 8/1971 | Hinkle | 292/29 X |
| 3,715,552 | 2/1973 | Umezu et al. | 219/10.55 |
| 3,715,554 | 2/1973 | Umezu et al. | 219/10.55 |
| 3,722,236 | 3/1973 | Zelenko | 70/78 |
| 3,731,035 | 5/1973 | Jarvis et al. | 219/10.55 |
| 3,733,456 | 5/1973 | Blackburn | 219/10.55 |
| 3,777,098 | 12/1973 | Tapper | 219/10.55 |
| 3,865,097 | 2/1975 | Robinson | 126/197 |
| 3,904,229 | 9/1975 | Waldo | 292/29 |
| 4,006,121 | 2/1977 | Isono | 200/61.64 |
| 4,101,750 | 7/1978 | Doner | 219/10.55 |

FOREIGN PATENT DOCUMENTS 2041438A 9/1980 United Kingdom ..... 292/DIG. 69

*Primary Examiner*—Richard E. Moore

*Attorney, Agent, or Firm*—Frederick P. Weidner; Radford M. Reams

[57] ABSTRACT

A latch assembly for securing a microwave oven door with an inner liner to the front face of the microwave oven including two spaced latch pawls pivotally secured to an elongated support member in the door and projecting through the inner liner of the door and movable to latching and unlatching positions. The pawls are individually biased to the latching position and a vertical handle on the outside of the door is secured to a transverse vertical actuator member such that upon pulling the handle, the actuator member rotates and pivots the pawls in unison to the unlatching position. The actuator member has secured at each end thereof pivot rods extending longitudinally beyond the actuator member and into bushings secured to the support member at each end. There is provided means to bias the actuator member longitudinally in one direction. By this arrangement close tolerance relationships are maintained for precise latching and unlatching of the latch assembly.

9 Claims, 11 Drawing Figures

FIG. 10
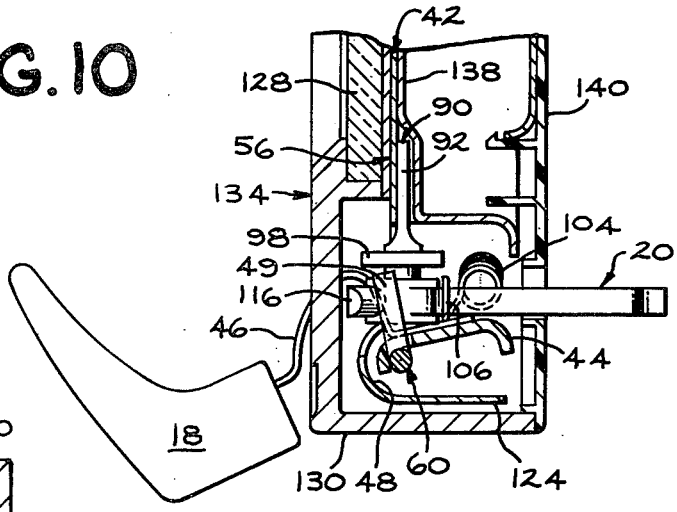
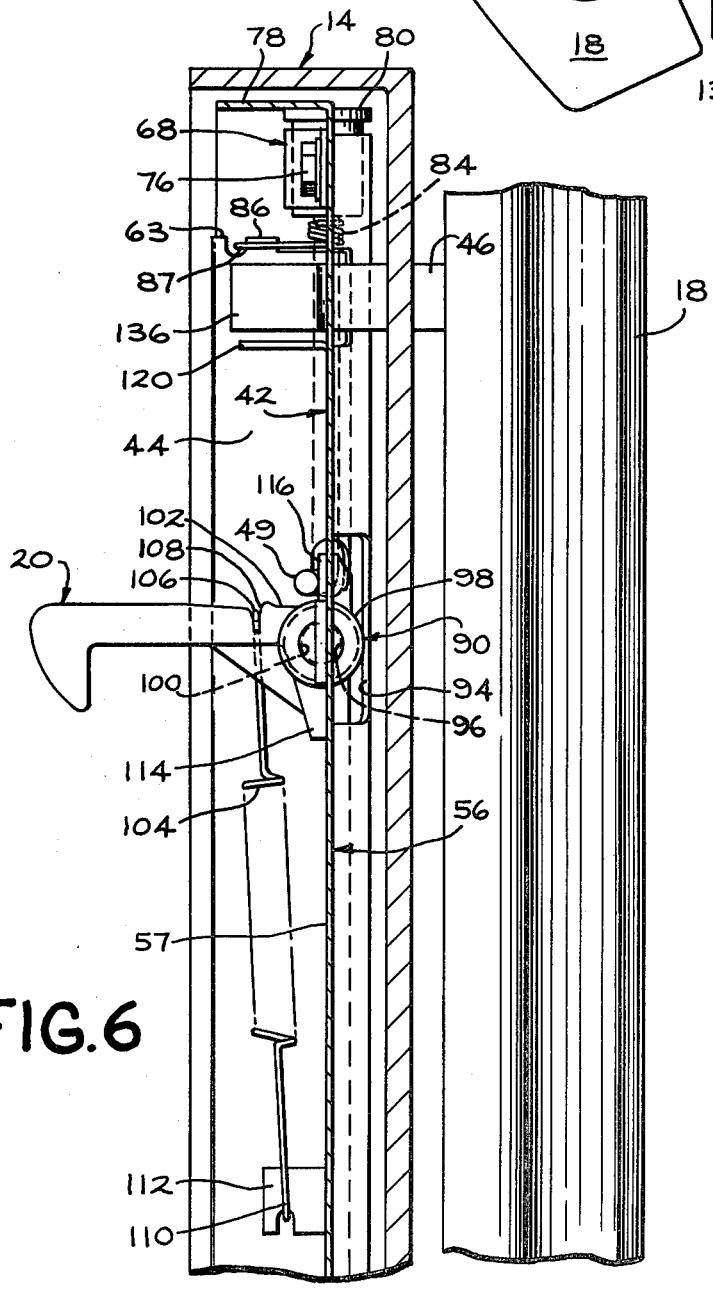
FIG. 6
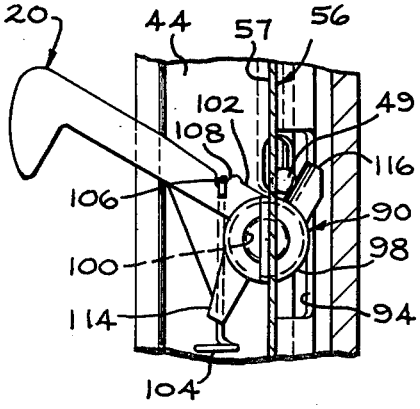
FIG. 11

DOOR LATCH ASSEMBLY

BACKGROUND OF THE INVENTION

The present invention relates to a latch assembly and particularly a latch assembly for use in a microwave oven.

In the conventional microwave oven, a microwave energy generating device is provided for delivering microwave energy into a cavity defined by a cabinet having a front opening selectively closed by a door. To assure there is very little leakage of the microwave energy from the cavity during operation of the oven, it is important that the door be properly closed and access to the oven cavity by the user is prevented when the microwave energy generating means is energized. Thus, it is conventional to provide interlocking means for assuring that the cabinet door is in the closed and latched position before the microwave energy generating means may be energized. A number of different interlocking systems have been developed to provide such functioning. Most common is a mechanism wherein a latch secured to the door will engage a switch secured to the oven which switch will permit energization of the microwave energy generating device only when the door is in its closed and latched position. When the door is opened and the latch removed from contact with the switch the microwave energy generating device is deenergized. See for example U.S. Pat. Nos. 3,715,552; 3,777,098; 3,865,097 and 4,101,750.

To aid in the proper functioning of the interlocking system it is important that the door be properly positioned against the face of the oven cavity during operation of the microwave energy generating device and also that the latch will engage the switch to energize the microwave energy generating device properly. In addition, it is desirable to have a latch assembly that operates easily and effectively with a minimum of manipulation and manual force by the user. By this invention there is provided a door latch assembly for microwave ovens which assures that the door is properly positioned, that the latch on the door properly actuates and deactuates the switch that energizes and deenergizes the microwave energy generating device respectively and is easily operable by the user.

SUMMARY OF THE INVENTION

In accordance with one aspect of the present invention, there is provided a latch assembly for securing a microwave oven door with an inner liner to the front face of the microwave oven including two spaced latch pawls pivotally secured to an elongated support member in the door and projecting through the inner liner of the door and movable to latching and unlatching positions. The pawls are individually biased to the latching position and there is a vertical handle on the outside of the door secured to a transverse vertical actuator member such that upon pulling the handle, the actuator member rotates and pivots the pawls in unison to the unlatching position. The actuator member has secured at each end thereof pivot rods that extend longitudinally beyond the actuator member and are retained in bushings secured to the support member at each end thereof. There is also provided means to bias the actuator member longitudinally in one direction. By this arrangement close tolerance relationships are maintained for precise latching and unlatching of the latch assembly.

BRIEF DESCRIPTION OF THE DRAWINGS

FIG. 6 shows the latch assembly of the present invention taken alongs lines 6—6 of FIG. 5.

FIG. 10 is similar to FIG. 9 with a portion of the latch assembly shown in the unlatched position.

FIG. 11 is a fragmentary view of a portion of the latch assembly shown in FIG. 6 but in the unlatched position.

DESCRIPTION OF THE PREFERRED EMBODIMENT

Figure 1:
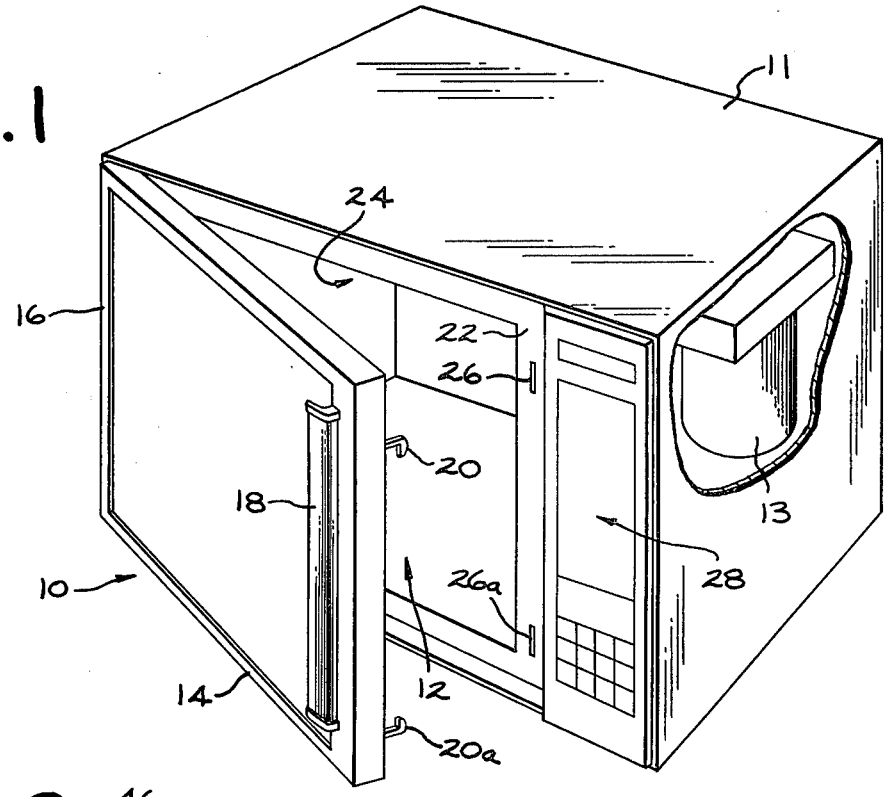
FIG. 1 is a perspective view of a countertop microwave oven with the door open showing a portion of the latch assembly of the present invention.
Figure 2:
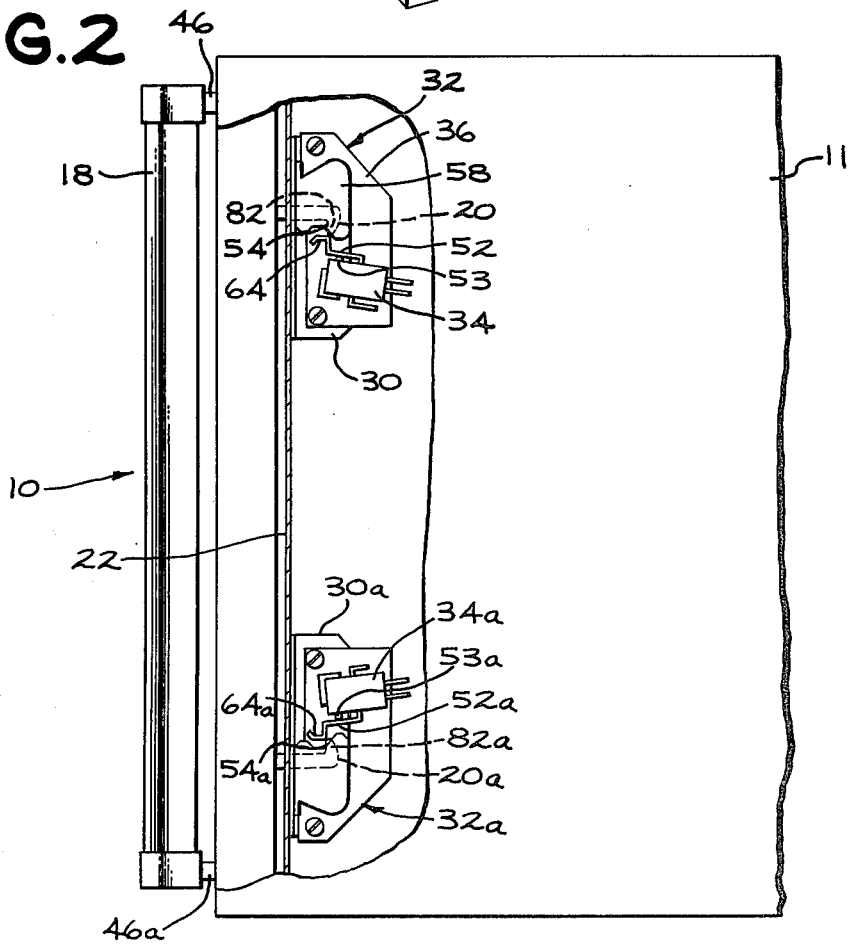
FIG. 2 is a side elevational view of the countertop microwave oven shown in FIG. 1 with a portion of the cabinet broken away to show part of the latch assembly in the latched position when the door is closed.

Referring to FIGS. 1 and 2, there is shown a microwave oven 10 comprising an outer casing or cabinet 11 enclosing a cooking cavity 12. An electrically operable microwave energy generating means 13 is provided for supplying electromagnetic energy to the cavity 12 in the conventional manner. The front opening 24 of the cavity 12 is closed by door 14 hinged at one end 16 and having a handle 18 at the opposite end with latch pawls 20 and **20*a* which are received through the front face 22 that surrounds the opening 24 by projecting through slot openings 26 and 26*a*** respectively when the door is in its closed position.

The front of the microwave oven 10 has a control panel 28 so that the user may control the energization and deenergization of the microwave energy generating means 13 when the door is closed and also select the desired mode of cooking. Behind and welded or otherwise attached to the front face 22 of the microwave oven 10 are rigid oven members 30 and **30*a*, a portion of each being adjacent the control panel 28. As seen in FIG. 2, attached to the oven rigid members 30 and 30*a* behind the slot openings 26 and 26*a* are switch assemblies 32 and 32*a*. The switch assemblies 32 and 32*a* include switches 34 and 34*a* rigidly secured to mounting members 36 and 36*a* which mounting members are secured to the oven rigid members 30 and 30*a* as will be explained hereinafter. The rigid members 30 and 30*a* and switch assemblies 32 and 32*a* are identical as far as concerning this invention and are merely mounted in the oven in an opposing manner. They do operate in an identical manner even though the respective switches may serve different purposes. Therefore, the structural arrangement and operation of the latch and switch assemblies and oven rigid members will be described with regard to latch pawl 20, switch assembly 32, and oven rigid member 30 and the corresponding elements for latch pawl 20***a*, switch assembly 32*a*, and oven rigid member 30*a* will be designated with the small letter "a."

There is shown in FIG. 2 an arrangement of switch assembly 32 wherein in the preferred embodiment the mounting member 36 is molded from suitable plastic material and includes a means for securely fastening the switch 34 to the mounting member 36. The switch 34 has an actuating arm 52 which is utilized in the usual manner such that depression of the actuating arm depresses a button 53 that actuates the switch and release of the actuating arm releases the button and deactuates the switch.

The mounting member 36 has integrally molded therewith a latch receiving strike plate 54 and a latch receiving cavity 58 which is arranged to overlie a hook-shaped portion 64 of the switch actuator arm 52 and is spaced just above the hook-shaped portion. The switch assembly 32 is securely positioned so that the latch receiving cavity 58 is located behind the slot opening 26 and that the latch receiving strike plate 54 has a portion thereof accessible through the opening 26. When the door 14 is closed latch pawl 20 passes through opening 26 in the front face 22 and comes into contact with the latch receiving strike plate 54. Upon continued movement of the door to its fully closed position the latch pawl 20 engages the latch receiving strike plate 54 with the downwardly depending hook projection 82 of the latch pawl 20. When the latch pawl 20 and strike plate 54 are so engaged there is in effect no slack or looseness in the latch assembly and the downwardly depending hook projection 82 of the latch pawl 20 engages the hook-shaped portion 64 and depresses the actuator arm 52 of switch 34 to permit energization of the microwave generating means 13 through an appropriate control system.

Figure 3:
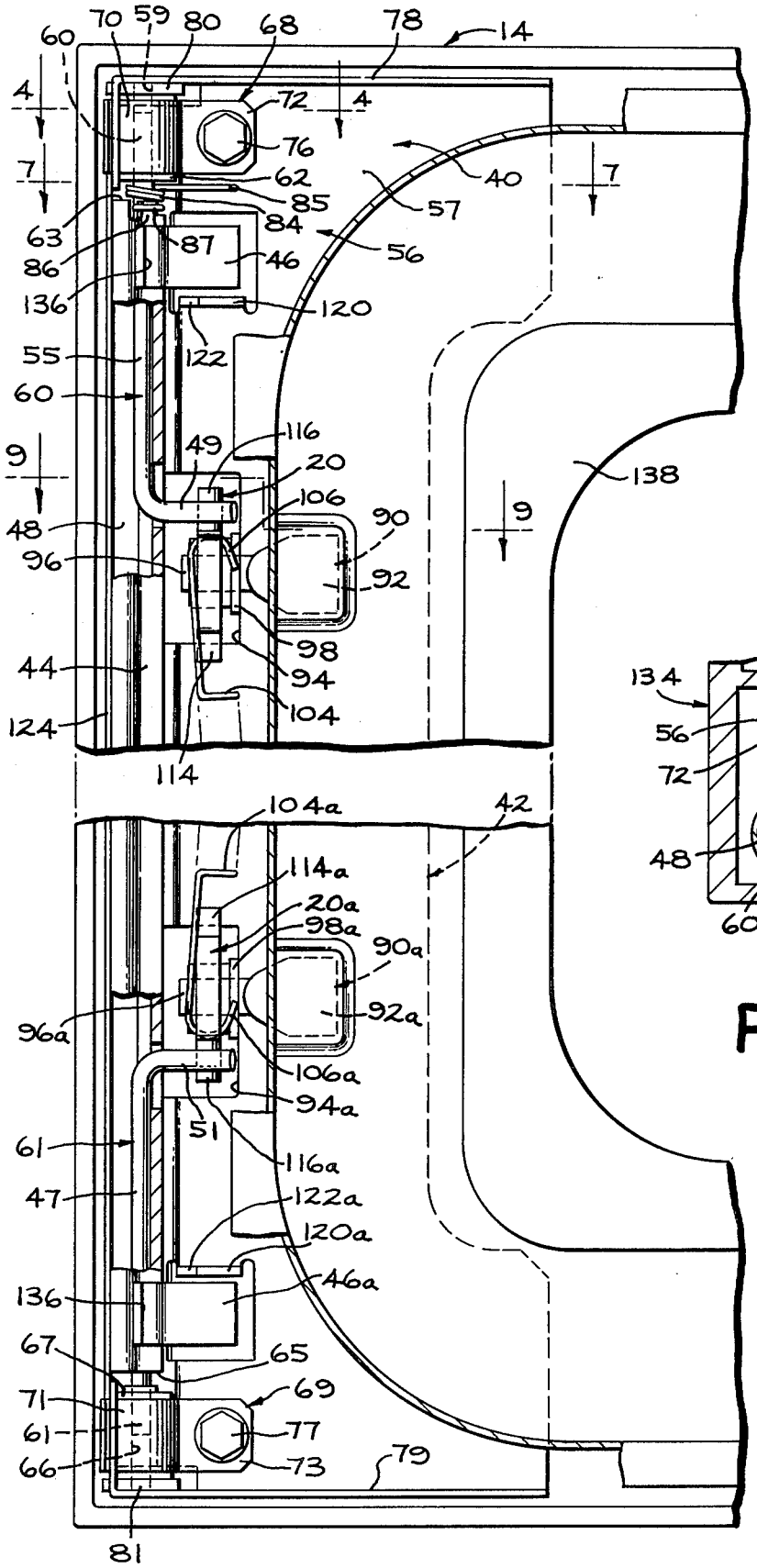
FIG. 3 is a rear elevational view of a portion of the latch assembly with the inner liner of a microwave oven door broken away to show the latch assembly of the present invention in the latched position.

With particular reference to FIGS. 3–6 the preferred embodiment of the latch assembly 40 of the present invention including the latch pawls 20 and 20*a* will be discussed. The latch assembly 40 is for securing the microwave oven door 14 to the front face 22 of the microwave oven and includes the latch pawls 20 and 20*a* which are spaced from each other and pivotally secured to an elongated support member 42 which is securely fastened inside the door by any suitable means such as screws (not shown). The latch pawls 20 and 20*a* are pivotally movably to latching and unlatching positions with the depending hook projections 82 and 82*a* opposing each other (FIG. 2). The latch assembly 40 includes a vertical handle 18 accessible to the user from outside of the door. The handle 18 is secured to a transverse vertical actuator member 44 by two spaced handle support members 46 and 46*a*. The transverse vertical actuator member 44, as shown in FIG. 3, extends from nearly one end of the elongated support member 42 to the other end and is utilized to pivot the latch pawls 20 and 20*a* to their unlatching positions by rotation of the transverse vertical actuator member 44 in response to movement of the handle 18 by the user. As pointed out previously, it is important in such a latch assembly that the latch pawls and their relationship to the actuator arm 52 of the switch 34 be precisely located and repeatedly so located over an extended period of usage. Since the latch pawls 20 and 20*a* are independently mounted on the support member 42 and the transverse vertical actuator member 44 that operates the latch pawls 20 and 20*a* is also mounted on the support member 42 the actuator member must be located relative to the support member precisely to assure proper functioning of the latching and unlatching operations of the latch pawls.

Figure 4:
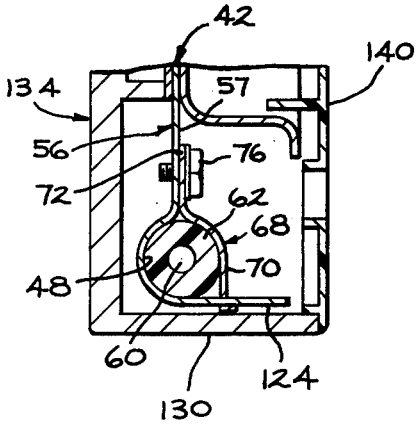
FIG. 4 is a cross-sectional view taken along lines 4—4 of FIG. 3.
Figure 7:
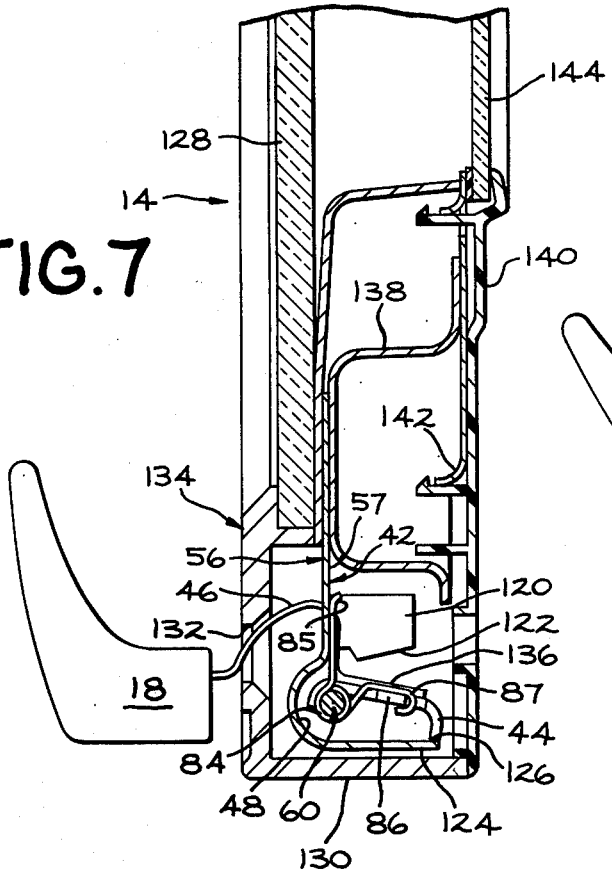
FIG. 7 is a cross sectional view of a portion of the latch assembly taken along lines 7—7 of FIG. 3.

The proper and precise location of the transverse vertical actuator member 44 relative to the elongated support member 42 is achieved by the following structural arrangement. The base 56 of the elongated support member 42 has a trough 48 along its entire length which trough as viewed in FIGS. 4 and 7 is C-shaped and extends below or departs from the upper surface 57 of the base 56 of the support member 42. The transverse vertical actuator member 44 has secured at each end thereof a pivot rod 60 and 61 respectively. Each pivot rod 60 and 61 has one leg 55 and 47 respectively parallel to the longitudinal axis of the actuator member 44 and another leg 49 and 51 at right angles to the legs 55 and 47 and in the preferred embodiment the pivot rods are welded to the actuator member 44. The pivot rods 60 and 61 extend longitudinally beyond the ends 63 and 65 respectively of the actuator member 44 and are received in cylindrical shaped bushings 62 and 67 that are received in the trough 48 at each respective end 63 and 65 of the elongated support member 42. The bushings 62 and 67 may be made of suitable plastic material and have an aperture 59 and 66 for receiving the ends of the pivot rods 60 and 61. The bushings 62 and 67 are retained in their proper location in the trough 48 by metal clamps 68 and 69 respectively that have a C-shaped portion 70 and 71 respectively that fits around the cylindrical bushings 62 and 67 and a flat portion 72 and 73 respectively that abuts the top surface 57 of the elongated support member 42 and is securely fastened thereto by fasteners 76 and 77. The elongated support member 42 has an upturned flange 78 and 79 at each end thereof and the rear surface 80 and 81 of each bushing abuts the respective flanges 78 and 79 so that their exact position will always be the same relative to the support member 42.

As pointed out above, it is important for precise operation of the latch assembly that the longitudinal alignment of the actuator member 44 relative to the support member 42 is always the same from one latch assembly to another and remains the same during extended usage. It is therefore important that the actuator member 44 be biased in one direction longitudinally so that if there is any tendency for tolerance deviation from one latch assembly to another during manufacture and assembly of the latch assembly and during extended usage of the latch assembly the system or mechanism will consistently provide the same alignment of the actuator member 44 relative to the support member 42. To accomplish this there is provided a coil spring 84 under compressive force located between the bushing 62 and the end 63 of actuator member 44 that acts to bias the actuator member 44 downwardly as viewed in FIG. 3 away from bushing 62 and in the direction of bushing 67. The coil spring 84 has one end 85 thereof engaging the top surface 57 of the support member 42 and the other end 87 secured to a tang 86 formed on the end 63 of actuator member 44. The coil spring 84 actually serves two purposes. The first is to continuously urge the actuator member 44 downwardly away from bushing 62 as mentioned above and secondly it acts as a torsion spring to aid in returning the actuator member 44 to its latching position upon release of the door handle by the user, as will be explained in more detail later.

Figure 5:
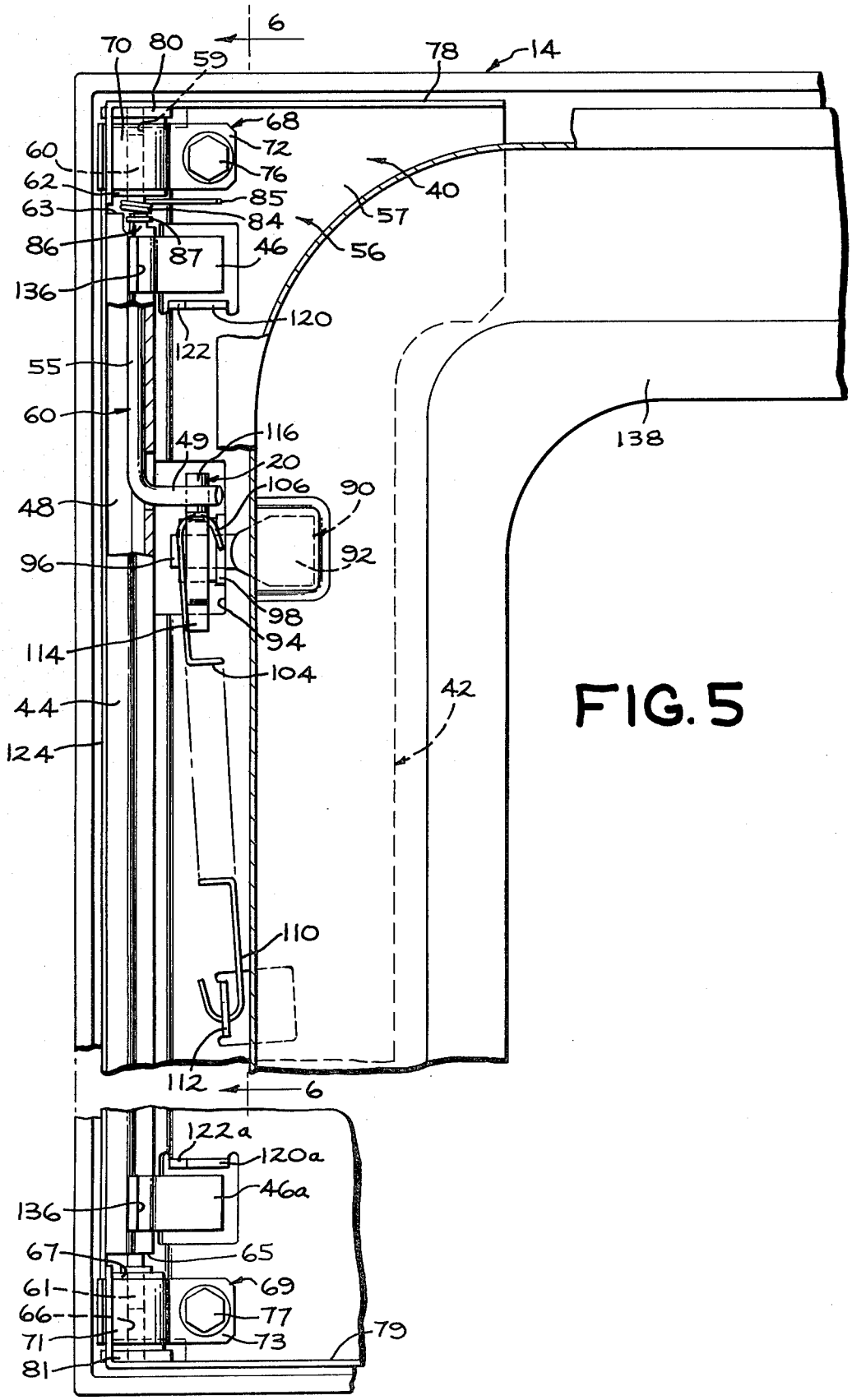
FIG. 5 is a rear elevational view of half of the latch assembly of the present invention.
Figure 9:
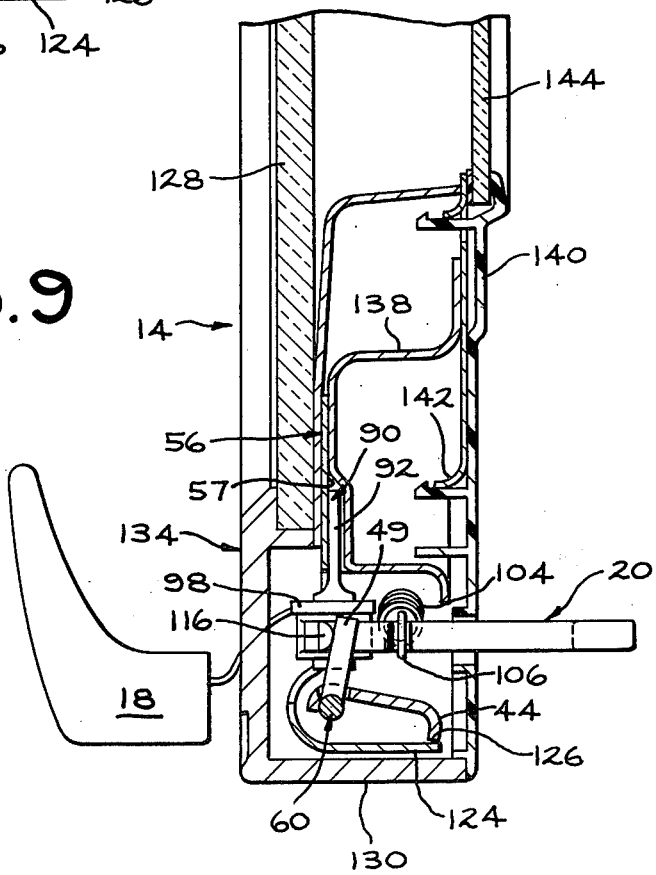
FIG. 9 is a cross sectional view taken along lines 9—9 of FIG. 3.

The latch pawls 20 and 20*a* are secured to the elongated support member 42 in similar arrangement which will be described in connection with latch pawl 20 and corresponding elements for securing latch pawl 20*a* will be designated by "a." Pivot stud 90 has one end portion 92 flat and welded to the top surface 57 of the support member 42 (FIGS. 3 and 5). The support member 42 has a cut out portion 94 into which extends the pivot portion 96 of the stud 90. Between the pivot portion 6 and the flat portion 92 is a circular shoulder 98 (FIGS. 3, 6 and 9). As most clearly seen in FIG. 6, the base or lower portion 102 of the latch pawl 20 has an aperture 100 slightly larger in diameter than that of the pivot portion 96 of the stud 90 so that it can be placed upon and rotate about the pivot portion and also the pivot portion 96 is slightly longer than the width of the lower portion 102 through which the pivot portion passes. This allows some slight movement of the latch pawl along the axis of the pivot portion 96.

As seen particularly in FIGS. 5 and 6, the latch pawl 20 is biased in the latching position by a spring 104 which has one end 106 secured to the latch pawl in a notch 108 just above the lower portion 102. The opposite end 110 of the spring is secured to the elongated support member 42 by means of a notched upraised tang 112. The spring 104 is offcenter from one end to the other (FIG. 5) in that the end 110 of the spring 104 remote from the latch pawl 20 is offset from the latch pawl 20 in the direction of the flat portion 92 of the pivot stud 90. By this arrangement during rotational movement of the latch pawl 20 about the pivot portion 96 the latch pawl will by the spring force be moved or urged back in the direction of and against the circular shoulder 98.

The lower portion 102 of the latch pawl 20 has formed thereon a forward stop projection 114 that abuts the upper surface 57 of the support member 42 when the latch pawl is in its proper upright latching position as shown in FIG. 6. It will be understood that force applied by the spring 104 will be overcome by the stop projection 114 abutting the upper surface 57 and prevent further forward rotational movement of the latch pawl 20. The lower portion 102 of the latch member also has a rearward projecting element 116 which engages leg 49 of the pivot rod 60 which leg 49 is at a right angle to the leg 55 of the pivot rod 60. With this arrangement then by rotating the actuator member 44 as by pulling on the handle 18 leg 49 of the pivot rod will exert force on the element 116 of the latch pawl 20 forcing the element 116 downward to cause the latch pawl 20 to be rotated (clockwise as viewed in FIG. 6) about the pivot portion 96 of the stud 90 and move the latch pawl to the unlatching position as shown in FIGS. 10 and 11. To prevent excessive rotation of the actuator member 44 and place the latch pawl 20 in its proper unlatching position, the support member 42 has lanced portions bent at right angles to the top surface 57 to form a stop element 120 which is positioned and functions such that the actuator member 44 is prevented from excessive rotation by abutting against the edge 122 of the stop element 120. Rotational movement of the actuator member 44 in the opposite direction allows the latch pawl 20 to be biased to the latching position by the spring 104 once the transverse vertical actuator 44 is rotated by the springs 104 and 104*a* with the aid of the torsion spring 84 upon release of the handle 18 by the user. Rotation of the vertical actuator 44 by these springs is stopped at the correct position by a longitudinally upturned flange 124 of the support member 42 so that the edge 126 of the vertical actuator 44 abuts the flange 124 and thus stop its rotational movement when the latch pawl 20 is in its latching position (FIGS. 7 and 9).

Figure 8:
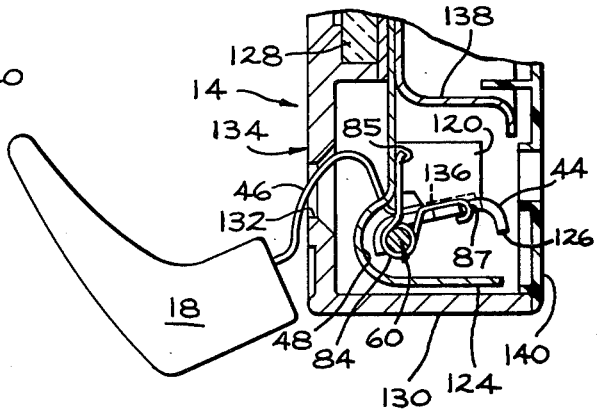
FIG. 8 is similar to FIG. 7 but with a portion of the latch assembly shown in the unlatched position.

The latch assembly 40 is assembled as a subassembly and is then incorporated in the microwave oven door 14 as will be most readily seen in FIGS. 7–9. The door 14 includes an outer glass plate 128 surrounded and retained by a frame or door trim 130. The door trim 130 has apertures 132 through the end generally designated 134 opposite from the hinged end 16 to allow the handle support members 46 to pass from the handle 18 through the apertures 132 and have the portion 136 of the handle support members secured as by welding to the transverse vertical actuator 44. By this arrangement then when handle 18 is moved by the user from its position shown in FIG. 7 which is the latching position to the unlatching position shown in FIG. 8 the rigid handle support members 46 securely fastened to the transverse vertical actuator 4 rotationally moves the actuator to the unlatching position shown in FIG. 8. Release of the handle 18 as previously described allows the springs 104 and 104*a* to exert force on the pawls 20 and 20*a* which pivot and moves rearward projecting elements 116 and 116*a* against legs 49 and 51 of pivot rods 60 and 61 and raises them. This action along with some force applied by the torsion spring 84 returns the vertical actuator 44, handle support member 46 and handle 18 to the latching position again shown in FIG. 7. Located inside the door 14 is a metal choke member 138 surrounding the opening 24 when the door is closed and also a plastic choke cover 140 that also surrounds the opening 24 when the door is closed and is secured to the door trim 130. A retaining member 142 carrying an inner glass plate 144 completes the inner door liner structure. These elements along with the subassembly latch assembly 40 are arranged as shown in FIGS. 7–9 and cooperate to securely retain the latch assembly 40 within the door 14 with the latch pawls 20 and 20*a* extending out through openings in the door liner so that they project through the inner liner of the door and will enter the slot openings 26 and 26*a* upon closing of the door as shown in FIG. 2.

It is realized that other modifications and changes will occur to those skilled in the art. It is therefore to be understood that the appended claims are intended to cover all such modifications as fall within the true spirit and scope of the invention.

1. In a latch assembly for securing a microwave oven door having an inner liner to the front face of a microwave oven, said latch assembly including two spaced latch pawls pivotally secured to an elongated support member in the door and projecting through the inner liner of the door and movable to latching and unlatching positions, said pawls being biased to the latching position, and a vertical handle on the outside of the door secured to a transverse vertical actuator member such that upon pulling the handle, the actuator member rotates and pivots the pawls in unison to the unlatching position, the improvement comprising:

the actuator member having secured at each end thereof pivot rods extending longitudinally beyond the actuator member, bushings secured to the support member at each end to retain the respective pivot rods, and means to bias the actuator member longitudinally in one direction.

2. The latch assembly of claim 1 wherein the actuator member is rotationally biased to the latching position.

3. The latch assembly of claim 2 wherein the support member has stop means to limit rotational movement of the actuator member in both directions.

4. The latch assembly of claim 1 wherein the means to bias the actuator member longitudinally in one direction is a coil spring around one pivot rod between the bushing and actuator member.

5. The latch assembly of claim 4 wherein the coil spring acts as a torsion spring to bias the actuator member to the latching position.

6. The latch assembly of claim 1 wherein the support member has a trough along one longitudinal edge and the bushings are located in the trough.

7. The latch assembly of claim 1 wherein the pivot rods each have a right angle leg away from the pivot end that cooperates with each respective pawl to pivot the pawls to the unlatching position upon rotational movement of the actuator member.

8. The latch assembly of claim 1 wherein each pawl is biased to the latching position by a separate tension spring one end of which is attached to the bottom portion of the pawl and the other end to the support member.

9. The latch assembly of claim 8 wherein the end of the tension spring attached to the actuator member is longitudinally off-center from the pivot point of the pawl in the direction away from the actuator member.

* * * * *